US005775193A

United States Patent [19]

Pratt

[11] Patent Number: 5,775,193

[45] Date of Patent: Jul. 7, 1998

[54] CRUSH-SLITTING STRUCTURE

[76] Inventor: Donald P. Pratt, 9875 New Oregon Rd., Eden, N.Y. 14057

[21] Appl. No.: 673,662

[22] Filed: Jun. 25, 1996

[51] Int. Cl.[6] ..... B26D 1/22

[52] U.S. Cl. ..... 83/659; 83/346; 83/425.4; 83/505; 83/508.3

[58] Field of Search ..... 83/302, 343, 344, 83/346, 434, 505, 506, 508.2, 508.3, 659, 56, 332, 425.4, 425.3, 436.1, 436.15, 436.3, 436.4, 436.7, 436.75, 347; 198/789, 781.08; 193/35 R

[56] References Cited

U.S. PATENT DOCUMENTS

| | | | |
|---|---|---|---|
| 259,151 | 6/1882 | Holbon | 83/425.3 |
| 1,863,619 | 6/1932 | Cameron | 83/505 X |
| 3,241,415 | 3/1966 | Brown | 83/433 |
| 3,866,502 | 2/1975 | Brewer, Sr. | 83/425.3 X |
| 3,869,999 | 3/1975 | Richter | 83/505 X |
| 3,996,828 | 12/1976 | Granger et al. | 83/500 |
| 4,092,886 | 6/1978 | Nowisch | 83/56 |
| 4,413,541 | 11/1983 | Biggar, III | 83/346 |
| 4,542,671 | 9/1985 | Kesten | 83/505 X |
| 4,742,745 | 5/1988 | Cremona | 83/344 |
| 4,989,487 | 2/1991 | Staley | 83/506 |
| 5,156,076 | 10/1992 | Rosemann | 83/344 |
| 5,174,185 | 12/1992 | Aichele | 83/346 |

*Primary Examiner*—Clark F. Dexter
*Attorney, Agent, or Firm*—Joseph P. Gastel

[57] ABSTRACT

A crush-slitting anvil structure including a frame, a backup roll rotatably mounted on the frame, an axle mounted on the frame in substantially parallel relationship to the backup roll, a roller anvil mounted on the axle and in engagement with the backup roll, and a rotatable knife mounted on the frame in contiguous relationship to the roller anvil. In one embodiment the axle is directly mounted on the frame, and in another embodiment the axle is mounted on a housing which is mounted on the frame.

14 Claims, 5 Drawing Sheets

CRUSH-SLITTING STRUCTURE

BACKGROUND OF THE INVENTION

The present invention relates to an improved crush-slitting structure for slitting a web.

By way of background, crush-slitters are well known in the art. Conventional crush-slitters utilize an elongated glass-hard roll mounted in the frame of a web-slitting machine. The web to be slit passes between the glass-hard roll and rotatable knives which bear against the web which is backed up by the glass-hard roll. The reason that the roll has to be glass-hard is so that the knives will not mar it excessively. However, a glass-hard roll is extremely expensive, and when it is worn out, it has to be replaced at considerable expense. It is with overcoming the foregoing deficiency of the prior art that the present invention is concerned.

SUMMARY OF THE INVENTION

It is accordingly the principle object of the present invention to provide an improved crush-slitting structure which obviates the need for a glass-hard roll by utilizing an inexpensive anvil member having a rotatable anvil surface which is backed up by an inexpensive backup roll.

Another object of the present invention is to provide an improved crush-slitting structure wherein a plurality of inexpensive anvil members can be mounted on the crush-slitting structure in a simple and expedient manner, with each of the anvil members backed up by an inexpensive backup roll.

It is a further object of the present invention to provide an improved crush-slitting anvil member utilizing a conventional ball bearing having a sufficiently hard outer race which functions as an anvil and against which a knife can bear during a web-slitting operation.

Still another object of the present invention is to provide an anvil member mounting a conventional ball bearing having an outer race which functions as an anvil member with the anvil member having a housing supporting the ball bearing to permit replacement of the ball bearing after it becomes worn.

Yet another object of the present invention is to provide a crush-slitting anvil member having a housing which can be mounted on a web-slitting machine in a simple and expedient manner. Other objects and attendant advantages of the present invention will readily be perceived hereafter.

The present invention relates to a crush-slitting anvil structure comprising a frame, a backup roll rotatably mounted on said frame, an axle mounted on said frame in substantially parallel relationship to said backup roll, a roller anvil mounted on said axle, and a rotatable anvil surface on said roller anvil in engagement with said backup roll.

The present invention also relates to a crush-slitter comprising a frame, a backup roll rotatably mounted on said frame, an axle mounted in substantially parallel relationship to said backup roll, a roller anvil mounted on said axle, a rotatable anvil surface on said roller anvil in engagement with said backup roll, and a knife mounted on said frame in contiguous relationship to said anvil surface.

The present invention also relates to a crush-slitting anvil member comprising a housing, a side wall on said housing, an axle mounted on said side wall, and a roller anvil having an inner portion mounted on said axle and an outer rotatable anvil surface portion located outwardly of said inner portion.

The present invention will be more fully understood when the following portions of the specification are read in conjunction with the accompanying drawings wherein:

DESCRIPTION OF THE PREFERRED EMBODIMENTS

A first embodiment of the present invention is shown in FIGS. 1–5 and a second embodiment is shown in FIGS. 6–9. Summarizing briefly in advance, in the first embodiment of a crush-slitting anvil structure, a plurality of anvil members each having a roller anvil mounted in a housing are shown which are mounted on the frame of a crush-slitter, with all of the roller anvils backed up by a single backup roll. In the second embodiment of a crush-slitting anvil structure, a plurality of roller anvils are spacedly mounted on an elongated axle mounted on the frame of the crush-slitter, with all of the roller anvils backed up by a single backup roll.

Figure 1:
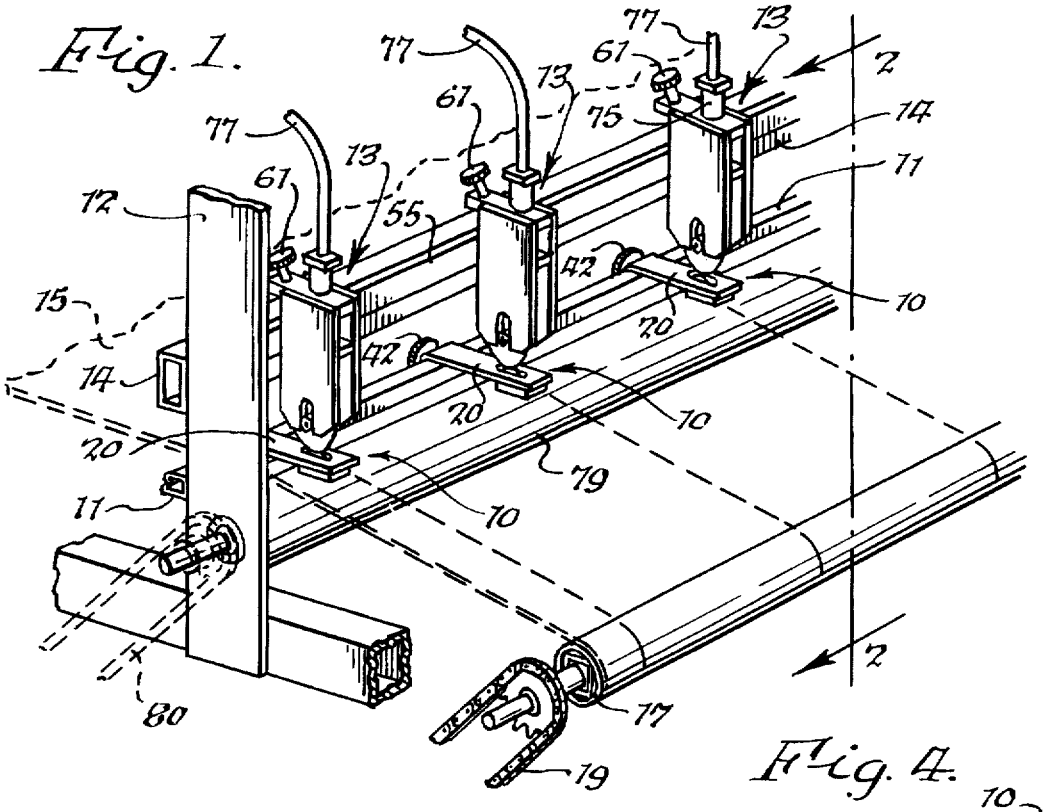
FIG. 1 is a fragmentary perspective view of a crush-slitting structure mounting a plurality of a first embodiment of crush-slitting anvil members and a backup roll.

In the first embodiment of FIGS. 1–5 a plurality of crush-slitting anvil members 10 are shown mounted on bar 11 mounted on frame 12 of a crush-slitter which also mounts a plurality of cutter devices 13 mounted on bar 14 which is also mounted on frame 12 of the crush-slitter. While only one side of frame 12 is shown in FIG. 1, it will be appreciated that frame 12 has mirror image counterparts of the side which is shown which supports parts which are analogous to parts 11, 14 and 79 of the crush-slitter. In operation a web 15 passes between cutter devices 13 and crush-slitting anvil members 10 and is wound onto a takeup roller 17 which is suitably driven by a chain drive 19.

In accordance with the first embodiment of the present invention, each crush-slitting anvil member 10 includes a housing 20 having a top wall 21. A roller anvil support structure 27 is welded to the underside of top wall 21, and it includes a pair of side walls 22 having their upper edges welded to the underside of top wall 21 at 23 and end walls 24 which join side walls 22, as can best be seen in plan in FIG. 4.

Figure 4:
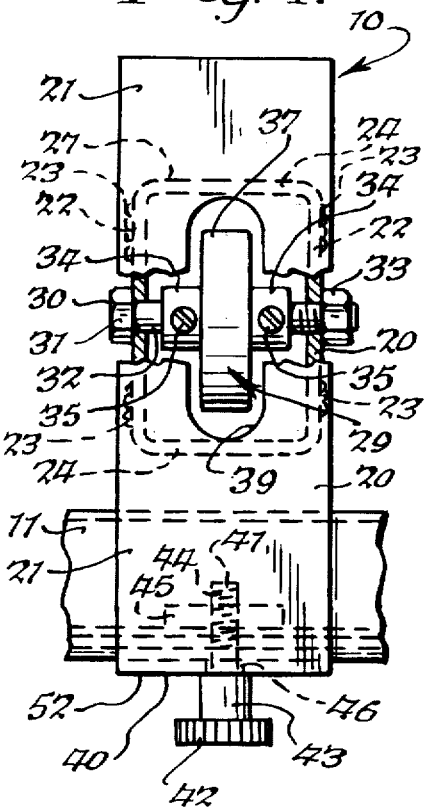
FIG. 4 is a view taken substantially in the direction of arrows 4—4 of FIG. 3 and showing a plan view of the crush-slitting anvil member in partially broken away form.

A roller anvil is provided in the form of a conventional ball bearing 29. The outer race of the conventional ball bearing 29 can be used as a crush-slitting surface against which a knife bears because the surface is sufficiently hard so that it will not be excessively marred by the knife. Ball bearing 29 is replaceably mounted on an axle 30 which extends between side walls 22 (FIG. 4). More specifically, axle 30 is essentially a conventional bolt having a head 31 and a shank 32 which is threaded at its end which mounts a nut 33, thus securing axle 30 between side walls 22. Ball bearing 29 is axially located on axle 30 by means of a pair of collars 34 which are secured to axle 30 by set screws 35. The outer race 37 of ball bearing 29 extends through slot 39 in top wall 21, as can be seen from FIGS. 2, 3 and 5. While upper wall 21 is broken away in FIG. 4 to show collars 34, it will be appreciated that slot 39 is continuous, as can be visualized from FIGS. 2 and 5. The top wall 21 not only carries side walls 22, but also acts as a surface which supports the web 15 as it travels longitudinally.

Figure 2:
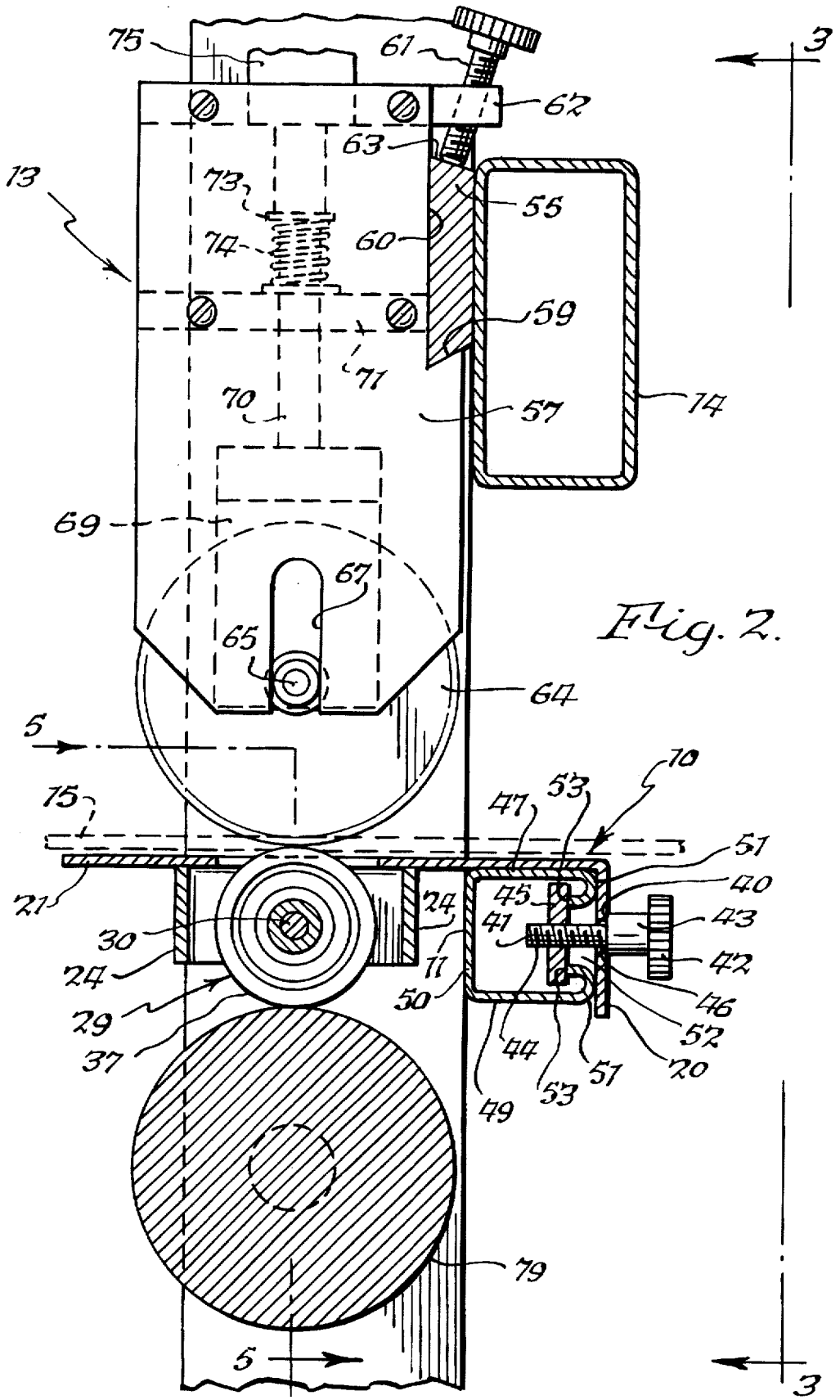
FIG. 2 is an enlarged fragmentary cross sectional view taken substantially along line 2—2 of FIG. 1 and showing the first embodiment crush-slitting anvil member mounted on a bar of the crush-slitting structure and located relative to its backup roll and the associated knife.

The housing 20 of crush-slitting anvil member 10 also includes a mounting wall 40 which extends perpendicularly to top wall 21 (FIG. 2). A bolt 41 is rotatably, not threadably, mounted in a hole 46 (FIG. 4) in mounting wall 40. Bolt 41 includes a head 42 which can be rotated digitally. A neck 43 of bolt 41 has a shoulder (not numbered) which bears against mounting wall 40 while the shank 44 extends through hole 46 in mounting wall 40. A plate 45 which serves as a nut is threadably mounted on shank 44.

Figure 3:
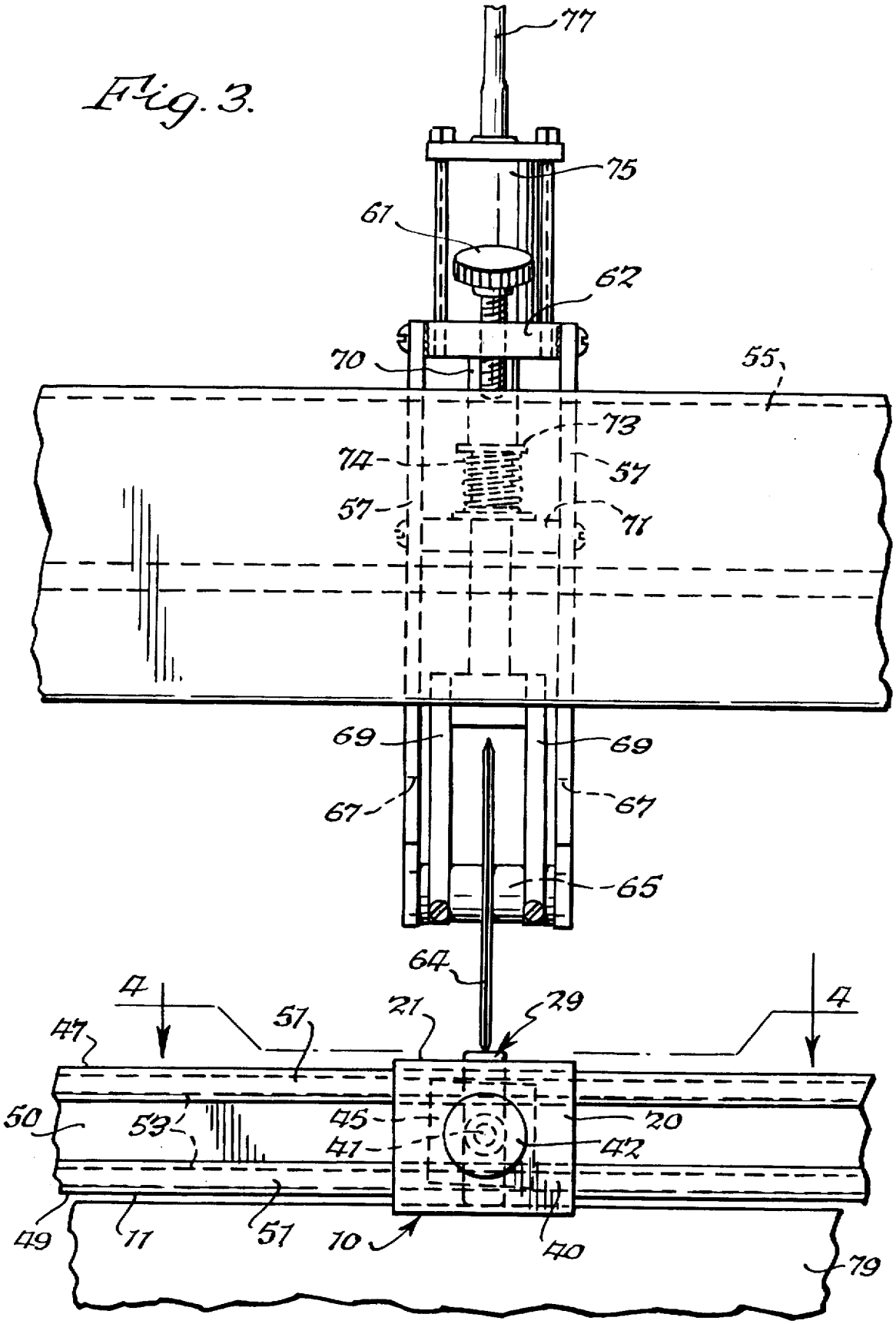
FIG. 3 is a fragmentary view taken substantially in the direction of arrows 3—3 of FIG. 2.
Figure 6:
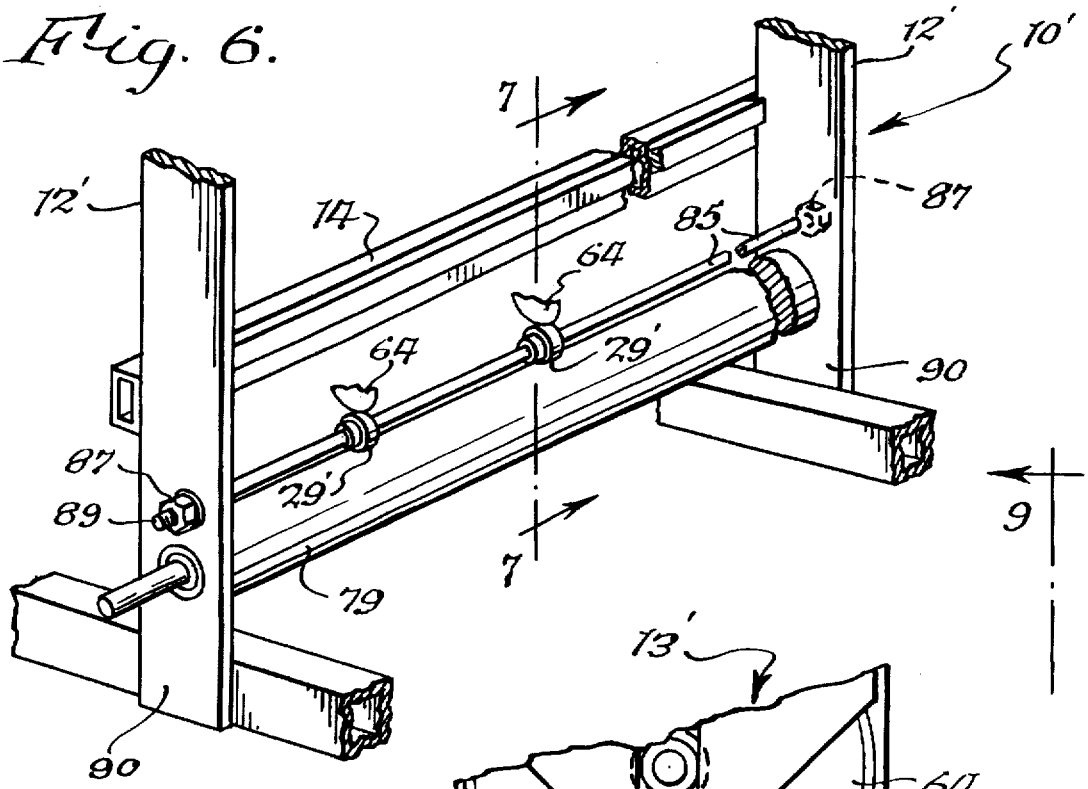
FIG. 6 is a fragmentary perspective view of a second embodiment of a crush-slitting structure wherein a plurality of crush-slitting anvils are spacedly mounted on an axle and are backed up by a backup roll.
Figure 7:
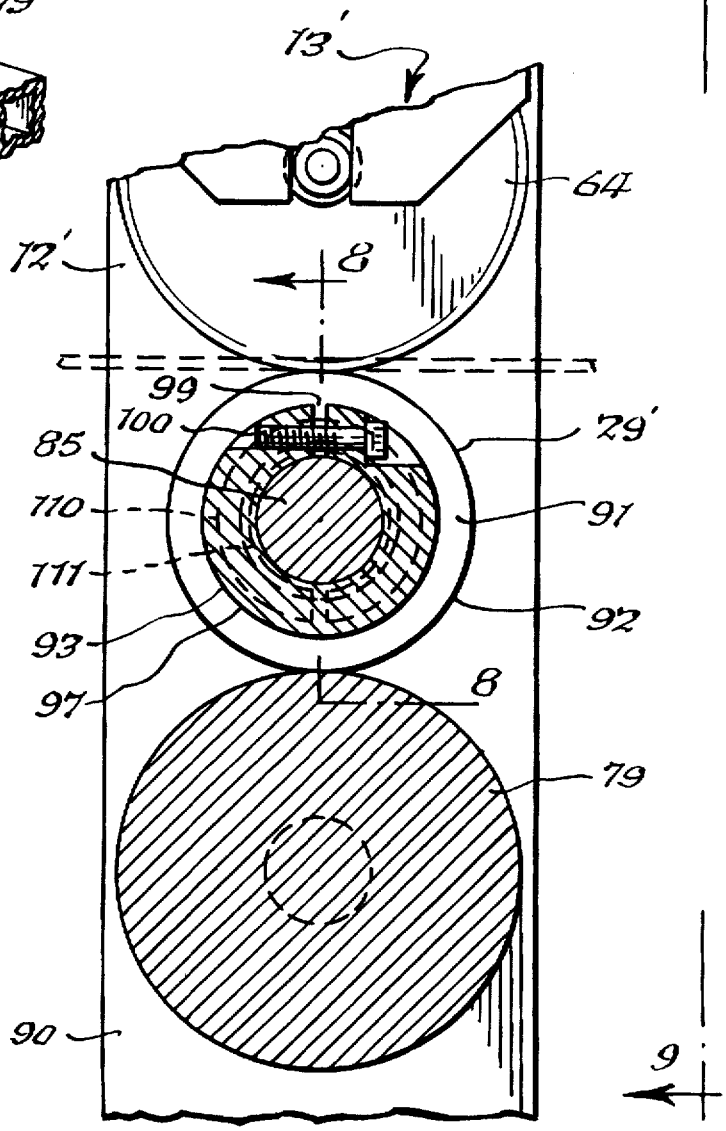
FIG. 7 is a fragmentary enlarged cross sectional view taken substantially along line 7—7 of FIG. 6.
Figure 8:
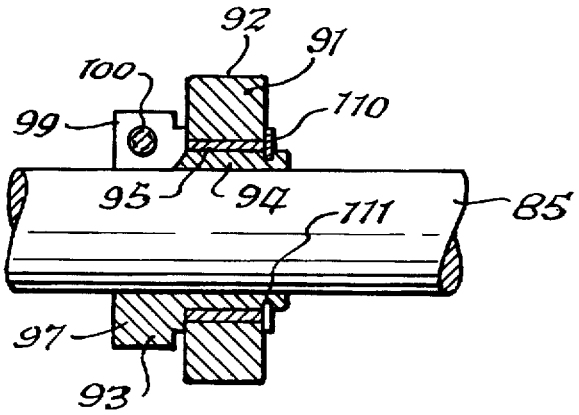
FIG. 8 is a fragmentary view taken substantially along line 8—8 of FIG. 7 and showing the adjustable mounting for the crush-slitting anvil.
Figure 9:
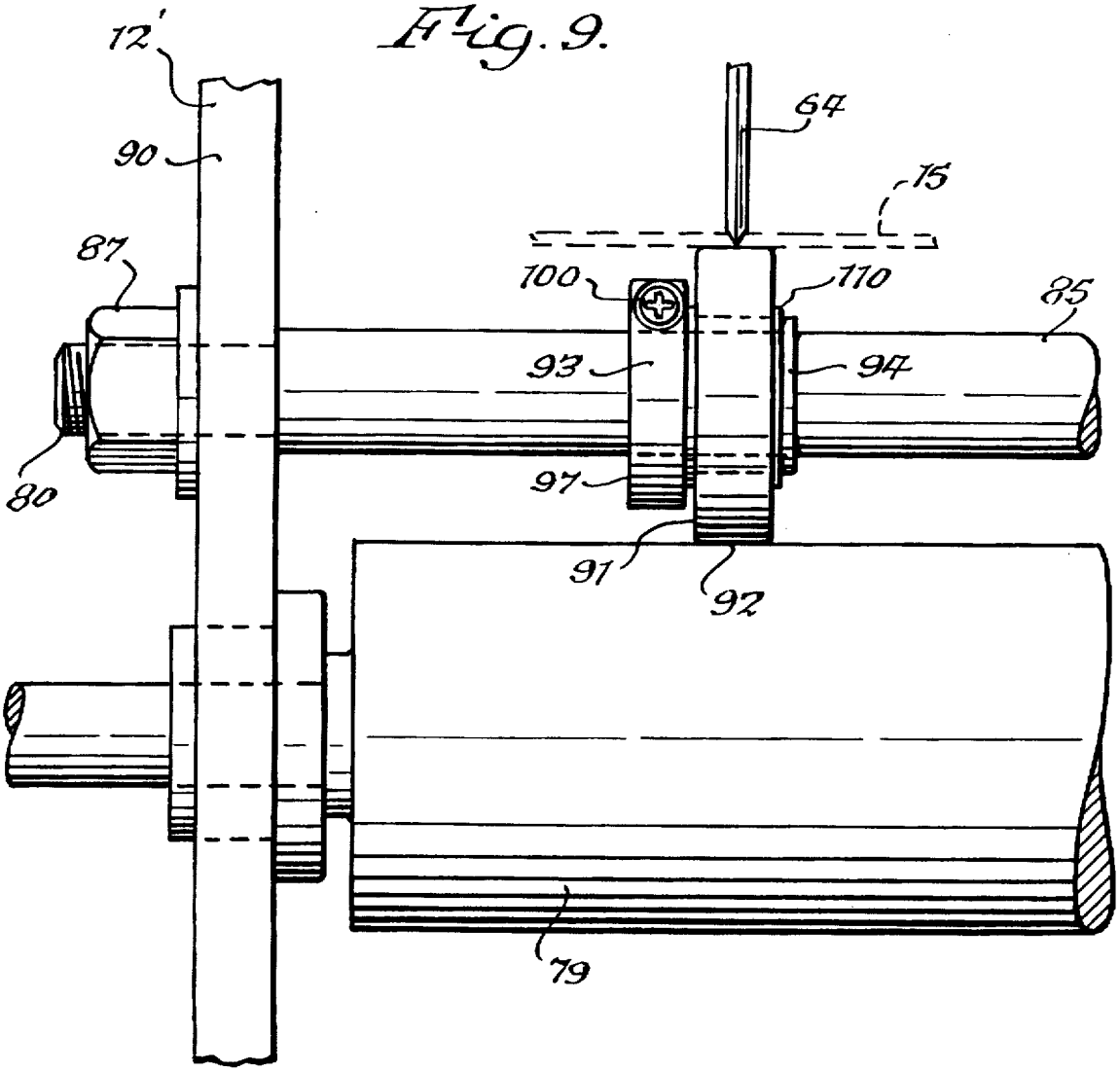
FIG. 9 is a fragmentary view taken substantially in the direction of the arrows 9—9 of FIG. 7.

The housing is mounted on bar 11 which is mounted on the frame 12 of the crush-slitter 10, as can be visualized from FIGS. 2 and 3. In this respect, bar 11 is in the shape of a channel having a top wall 47, a bottom wall 49, and an end wall 50 which is suitably secured to frame 12. The channel 11 has an open side 51 with an opening 52 (FIGS. 1, 2 and 3) therein which extends throughout the length of channel 11. This permits the plate 45 to be slid into the opening 52. When bolt 41 is tightened, plate 45 will bear against the edges or surfaces 53 of the inturned portion of wall 51 while shoulder 46 of neck 43 bears against mounting wall 40 which, in turn, bears against side or surfaces 51 of channel bar 11, to thereby securely mount housing 20 on channel bar 11. As can be visualized from FIG. 1, the foregoing type of mounting permits a plurality of crush-slitting anvil members 10 to be mounted along channel-shaped bar 11 and to be positioned as required for slitting a web 15 into different width portions.

A conventional prior art cutting wheel assembly 13 is mounted on bar 14. In this respect, a dovetail-shaped bar 55 is suitably secured to bar 14, and the housing sides 57 of cutting wheel assemblies 13 have cutaway portions at 59 and sides 60 which are complementary to a portion of the dovetail bar 55. A set screw 61 is threaded into plate 62, and when set screw 61 is tightened, it bears against the edge 63 of dovetail bar 55 to secure the cutter assembly 13 in position on bar 14. Each cutter assembly 13 can be mounted at any desired axial position on dovetail bar 55.

Insofar as pertinent here, each cutter assembly 13 includes a circular knife or cutter 64 which is rotatably mounted on shaft 65 which can be moved vertically in slots 67 of sides 57. Shaft 65 is carried by a yoke 69 which in turn is mounted on stem 70 which extends through plate 71 secured between cutter sides 57. A collar 73 is located on stem 70, and a spring 74 is positioned between plate 71 and collar 73 to bias stem 70 and cutter wheel 64 carried thereby upwardly. A pneumatic cylinder 75 which is mounted on top plate 62 has a piston which is attached to stem 70, and cylinder 75 receives compressed air through conduit 77. Thus when pneumatic cylinder 75 is actuated, yoke 69 and cutter wheel 64 carried thereby will be urged downwardly against the bias of spring 74. As noted above, the cutter assembly 13 per se is conventional in the prior art and forms only a part of the present invention in that it is representative of any cutter which can be used with the improved crush-slitting anvil members of the present invention operate.

Figure 5:
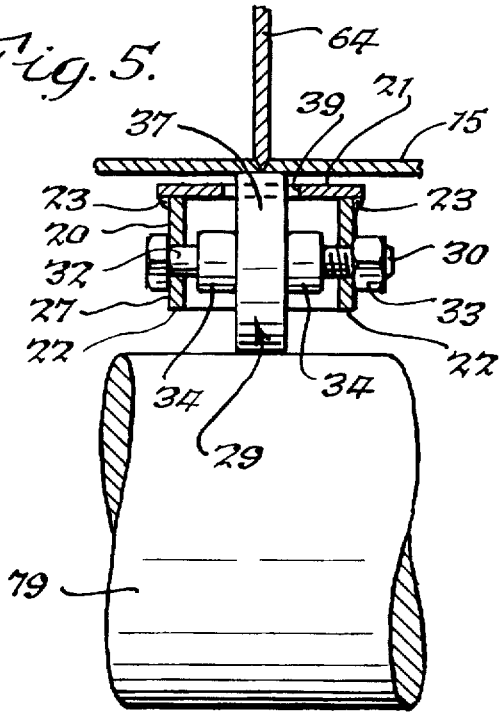
FIG. 5 is a fragmentary cross sectional view taken substantially along line 5—5 of FIG. 2.

As can be seen from FIGS. 2 and 5, a backup roll 79 is rotatably mounted in frame 12 and backup roll 79 supports each ball bearing 29. This is especially desired since each housing 20 is essentially cantilever-mounted on channel bar 11 which could result in a slight amount of downward vertical movement of the crush-slitting anvil housing 20 when the knife blade 64 bears against it.

As noted above, the outer surface of outer race 37 of ball bearing 29 is sufficiently hard so that it can serve as a glass-hard roller, and thus it is manifestly suitable as a anvil surface for knife 64, thereby being capable of replacing previously used glass-hard rolls which were very expensive. It is to be noted that, if desired, the ball bearings 29 can be driven by attaching a chain drive 80 to backup roll 79. This driving is effected because of the frictional relationship between backup roll 79 and ball bearing 29. However, positive driving of ball bearing 29 is not necessary because the web 15 can be pulled through the cutters by takeup roller 17 which is driven by chain 19.

It is to be especially noted that if the outer race 37 becomes worn, or if the ball bearing 29 becomes damaged in any respect, it can be replaced very easily by loosening collars 34 and removing axle 30 from frame 20, which results in the ball bearing 29 and collars 34 being stripped from the axle, and thereafter reassembling a new ball bearing and the collars onto the axle 30 as it is mounted between side walls 22, as is quite evident from the above-described structure.

In FIGS. 6–9 a second crush-slitter structure embodiment 10' is shown having a frame 12' mounting a cutter support bar 14 and a backup roller 79. The cutter support bar 14 carries a plurality of cutter devices 13 (such as shown in FIG. 1 but not completely shown in FIG. 6) which have rotatable blades 64. The crush-slitter 10' differs from the embodiment of FIGS. 1–5 in that the crush-slitter anvil structure 10' includes rotatable roller anvils 29' having glass-hard surfaces mounted on an elongated axle 85 having its opposite ends suitably mounted in frame 12' as by nuts 87 which thread onto threaded ends 89 of axle 85 which extends through uprights 90 of frame 12'. Roller anvils 29' are different in structure than ball bearings 29 of FIGS. 1–5. In this respect, as can be seen from FIG. 8, each roller anvil 29' includes an outer member 91 which has a surface 92 which is sufficiently hard so that it will not be marred appreciably by knife 64. Each roller anvil 29' is adjustably mounted on axle 85 by means of a split sleeve 93 having an internal portion 94 on which a bearing 95 is mounted and about which outer member 91 rotates. The split sleeve 93 includes a collar 97 with a split 99. A screw 100 extends across split 95 and screw 100 can be tightened to cause the collar 97 to clamp split ring 93 tightly onto axle 85 in any desired adjusted axial position. A split snap washer 110 fits in a groove 111 in sleeve 93 to retain bearing 95 and member 91 in mounted position on split sleeve 93. It will be appreciated however that a ball bearing such as 29 of FIGS. 1–5 can be adjustably mounted on axle 85 by means of collars 34 and associated set screws 35 in the same manner as shown in FIGS. 4 and 5. In fact, any rotatable member having a hardened outer surface which can be mounted on an axle such as shown in FIGS. 6–9 can be utilized as an anvil member.

Thus, in the embodiment of FIGS. 1–5, the crush-slitter anvil structure includes a housing 20 on which the roller anvil is mounted, wherein the roller anvil comprises a ball bearing 29 having a hardened outer surface, and in FIGS. 6–9 the roller anvil 29' comprises a rotatable member which is mounted directly on an elongated axle mounted on the frame of the crush-slitter. In both embodiments the roller anvil is supported by a backup roll. However, it will be appreciated that in certain circumstances the backup roll of FIGS. 1–5 can be eliminated and the roller anvil can be mounted on a housing which is cantilever-supported from the frame of the crush-slitter or, in certain circumstances, the roller anvil housing can be supported by spaced frame members at opposite end portions of the housing. Additionally, it will be appreciated that the housing which supports the axle need not necessarily have spaced walls but the axle itself can be cantilever-supported from a single wall. In short, the only requirement, broadly, is that a hardened roller surface need be supported either on an axle with a backup roll, as in FIGS. 6–9, or supported on an axle mounted on a housing which in turn is mounted on the frame of the machine and either supported with a backup roll or merely mounted on the housing which in turn is mounted on a crush-slitter.

While preferred embodiments of the present invention has been disclosed, it will be appreciated that it is not limited thereto but may be otherwise embodied within the scope of the following claims.

What is claimed is:

1. A crush-slitting anvil member in combination with a backup roller, said anvil member comprising a pair of side walls, upper and lower edge portions on said side walls, a top wall secured to said upper edge portions of said side walls, an axle supported by and extending between said side walls, an anvil roller mounted on said axle, a slot in said top wall, a portion of said anvil roller protruding through said slot in said top wall, said anvil roller extending beyond said lower edge portions of said side walls, and said backup roller being in engagement with said portion of said anvil roller which extends beyond said lower edge portions of said side walls.

2. A crush-slitting anvil member comprising a pair of side walls, upper and lower edge portions on said side walls, a top wall secured to said upper edge portions of said side walls, an axle supported by and extending between said side walls, an anvil roller mounted on said axle, a slot in said top wall, a portion of said anvil roller protruding through said slot in said top wall, said anvil roller extending beyond said lower edge portions of said side walls, a mounting wall secured to said top wall, a hole in said mounting wall, a bolt, a head on said bolt, a shank on said bolt extending through said hole, and a nut on said shank.

3. A crush-slitting anvil member as set forth in claim 2 including at least one end wall secured to and extending between said side walls.

4. A crush-slitting anvil member as set forth in claim 2 including at least one collar removably mounted on said axle between said anvil roller and one of said side walls.

5. A crush-slitting anvil member as set forth in claim 2 in combination with a bar, an opening in said bar, and said shank extending through said opening with said head and said nut on opposite sides of said opening.

6. A crush-slitting anvil member in combination with a bar as set forth in claim 5 including at least one collar removably mounted on said axle between said anvil roller and one of said side walls, and wherein said axle is removably mounted to and extends between said side walls.

7. A crush-slitting anvil member in combination with a bar as set forth in claim 6 and further in combination with a backup roller in engagement with said portion of said anvil roller which extends beyond said lower edge portions of said side walls.

8. A crush-slitting anvil member in combination with a bar and a backup roller as set forth in claim 7 including at least one end wall secured to and extending between said side walls.

9. A crush-slitting anvil member in combination with a backup roller and a bar, said anvil member comprising a pair of side walls, upper and lower edge portions on said side walls, a top wall secured to said upper edge portions of said side walls, an axle supported by and extending between said side walls, an anvil roller mounted on said axle, a slot in said top wall, a portion of said anvil roller protruding through said slot in said top wall, said anvil roller extending beyond said lower edge portions of said side walls, and said backup roller being in engagement with said portion of said anvil roller which extends beyond said lower edge portions of said side walls; said anvil member further comprising a mounting wall secured to said top wall, a hole in said mounting wall, a bolt, a head on said bolt, a shank on said bolt extending through said hole, and a nut on said shank; wherein said bar comprises an opening therein, and said shank extends through said opening with said head and said nut on opposite sides of said opening.

10. A crush-slitting anvil member in combination with a backup roller and a bar as set forth in claim 9 including an end wall secured to and extending between said side walls on an opposite side of said anvil roller from said mounting wall.

11. A crush-slitting anvil member comprising a pair of side walls, upper and lower edge portions on said side walls, a top wall secured to said upper edge portions of said side walls, an axle supported by and extending between said side walls, an anvil roller mounted on said axle, a slot in said top wall, a portion of said anvil roller protruding through said slot in said top wall, said anvil roller extending beyond said lower edge portions of said side walls, a mounting wall secured to said top wall, a hole in said mounting wall, a bolt, a head on said bolt, a shank on said bolt extending through said hole, and a nut on said shank, and said axle being removably mounted to and extending between said side walls.

12. A crush-slitting anvil member in combination with a backup roller, said anvil member comprising a top wall, a side wall secured to said top wall, an axle mounted on said side wall, an anvil roller mounted on said axle, a slot in said top wall, a first portion of said anvil roller protruding through said slot, and said backup roller being in engagement with a second portion of said anvil roller, said second portion being on an opposite side of said anvil roller with respect to said axle than said first portion.

13. A crush-slitting anvil member in combination with a backup roller as set forth in claim 12 wherein said anvil roller is removably mounted on said axle.

14. A crush-slitting anvil member in combination with a backup roller as set forth in claim 12 including an end wall secured to said top wall and to said side wall.

* * * * *